US008882314B1

(12) United States Patent
Chen

(10) Patent No.: US 8,882,314 B1
(45) Date of Patent: Nov. 11, 2014

(54) ELEVATION-ADJUSTABLE WINDOW CANDLE

(71) Applicant: Tse Min Chen, Hsinchu (TW)

(72) Inventor: Ching-Chao Chen, Hsinchu (TW)

(73) Assignee: Tse Min Chen, Hsinchu (TW)

( * ) Notice: Subject to any disclaimer, the term of this patent is extended or adjusted under 35 U.S.C. 154(b) by 74 days.

(21) Appl. No.: 13/897,904

(22) Filed: May 20, 2013

(51) Int. Cl.
*F21V 35/00* (2006.01)
*F21S 10/04* (2006.01)

(52) U.S. Cl.
CPC ..... *F21V 35/003* (2013.01); *F21S 10/04* (2013.01); *F21V 35/00* (2013.01)
USPC ..... 362/393

(58) Field of Classification Search
CPC ..... F21V 21/14; F21V 21/22; F21V 19/00; F21V 35/00; F21V 35/003; F21V 35/006; F21S 6/001; F21W 2121/00; F21W 2121/002
See application file for complete search history.

(56) References Cited

U.S. PATENT DOCUMENTS 8,231,253 B1 * 7/2012 Chen ..... 362/393
8,297,807 B1 * 10/2012 Chen ..... 362/393

* cited by examiner

*Primary Examiner* — Bao Q Truong
(74) *Attorney, Agent, or Firm* — Jackson IPG PLLC

(57) ABSTRACT

A window candle includes a holder base defining therein a stepped vertical insertion hole formed of a larger upper first insertion hole and a smaller lower second insertion hole and defining a first annular locating groove between the larger upper first insertion hole and the smaller lower second insertion hole and a second annular locating groove located at the bottom side of the smaller lower section insertion hole, a candle shaft inserted into the stepped vertical insertion hole and selectively positioned in the first annular locating groove or the second annular locating groove, an annular locating member optionally mountable in the first annular locating groove to support the candle shaft in the first annular locating groove, and a lampshell fastened to the top end of the candle shaft by a screw joint and holding therein a light-emitting circuit board.

3 Claims, 6 Drawing Sheets

ELEVATION-ADJUSTABLE WINDOW CANDLE

BACKGROUND OF THE INVENTION

1. Field of the Invention

The present invention relates to window candles and more particularly, to an elevation-adjustable window candle, which facilitates quick adjustment of the elevational position of the candle shaft in the holder base.

2. Description of the Related Art

A window candle has been a traditional practice in many cultures. Placing a candle in the window symbolizes the warmth and security of the family hearth and signals loyalty to family members and loved ones. Nowadays, many LED lamp type window candles have been created. A LED lamp type window candle generally comprises a base, a candlestick supported on the base, a candle shaft supported on the candlestick, and a lampshell supported on the candle shaft and a LED module mounted inside the lampshell and controllable to emit light through the lampshell. A conventional LED lamp type window candle does not allow adjustment of the elevation of the candle shaft, limiting the application.

U.S. Pat. No. 8,297,807, issued to the present inventor, discloses an elevation adjustable window candle, which includes a candlestick having axial sliding grooves axially disposed between stop portions and an inside shoulder therein, a candle shaft having springy retaining blocks equiangularly suspending in the bottom side thereof and respectively axially slidably coupled to the sliding grooves in the candlestick to secure the candle shaft to the candlestick at the desired elevation by means of friction resistance, and a lampshell mounted on the top end of the candle shaft and holding a LED lamp module therein. The elevation adjustment procedure of this design of elevation adjustable window candle is complicated. If the candle shaft and the candlestick are not kept in accurate alignment, accurate adjustment cannot be done. Further, the springy retaining blocks may wear quickly with use, resulting in positioning instability and shortening the lifespan of the window candle. Further, the candle shaft and the candlestick commonly have a complicated structure, increasing the manufacturing cost.

U.S. Pat. No. 8,231,253 discloses another design of adjustable window candle invented by the present invention. This design of adjustable window candle includes a candlestick, a positioning member mounted inside the shank body and having retaining flanges extending around the periphery thereof at different elevations, a candle shaft axially slidably sleeved onto the positioning device and having a locating groove extending around the inside wall thereof and selectively engageable with one retaining flange of the positioning member to secure the candle shaft to the positioning member in the candlestick in one of a series of elevational positions, and a lampshell mounted on a top end of the candle shaft and holding a LED lamp module therein. According to this design, the use of the positioning member complicates the installation procedure and increases the cost of the window candle. Further, the locating groove of the positioning device and the retaining flange of the positioning member may wear quickly with use, shortening the lifespan of the window candle.

SUMMARY OF THE INVENTION

The present invention has been accomplished under the circumstances in view. It is therefore the main object of the present invention to provide an elevation-adjustable window candle, which allows adjustment of the elevation position of the candle shaft in the holder base thereof to fit different application requirements.

It is another object of the present invention to provide an elevation-adjustable window candle, which has a simple structure that can easily be assembled with less labor and time, saving the cost and enhancing product competitiveness.

It is still another object of the present invention to provide an elevation-adjustable window candle, which uses a simple structure of candle shaft and a simple structure of holder base that are easy and inexpensive to manufacture, lowering the product cost.

DETAILED DESCRIPTION OF THE INVENTION

Figure 1:
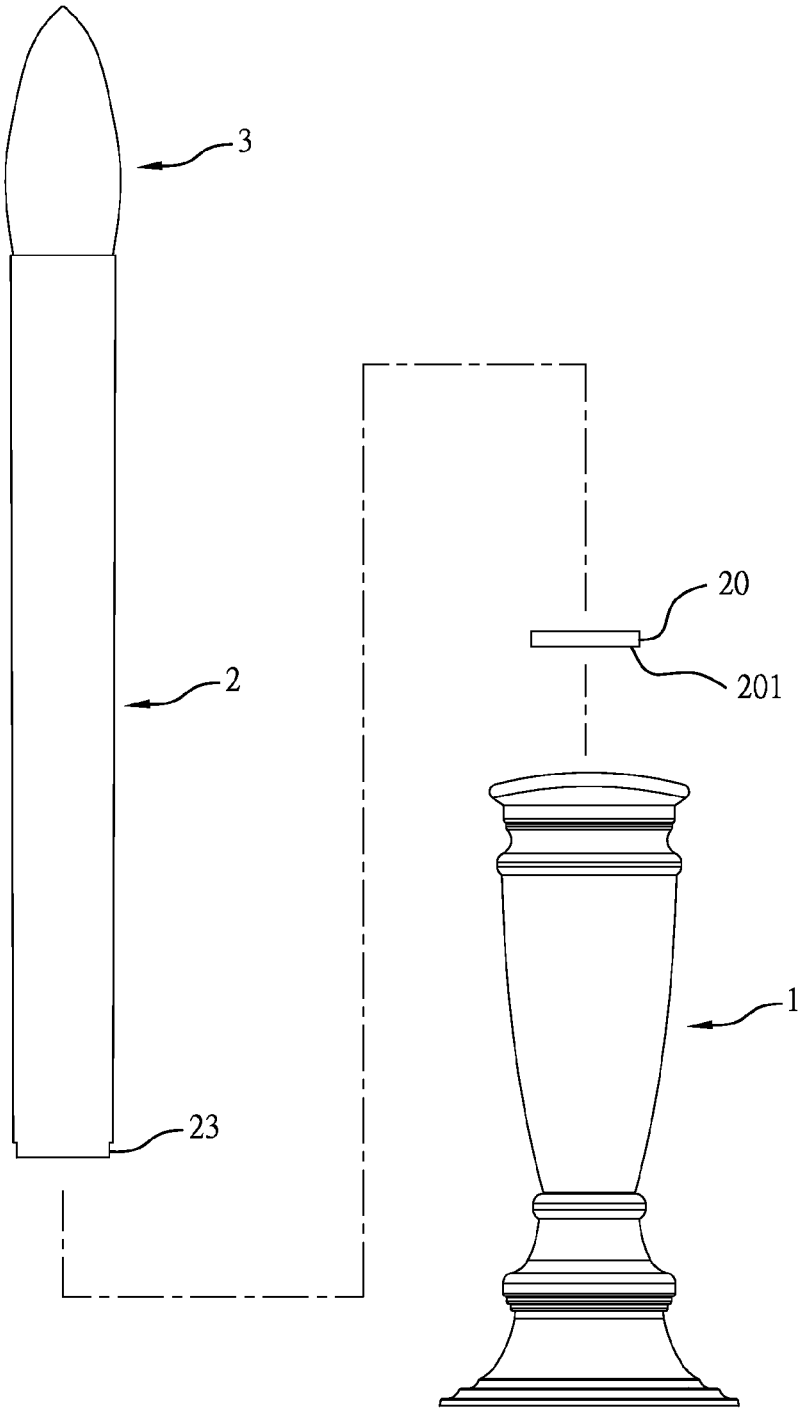
FIG. 1 is an exploded view of an elevation-adjustable window candle in accordance with the present invention.
Figure 2:
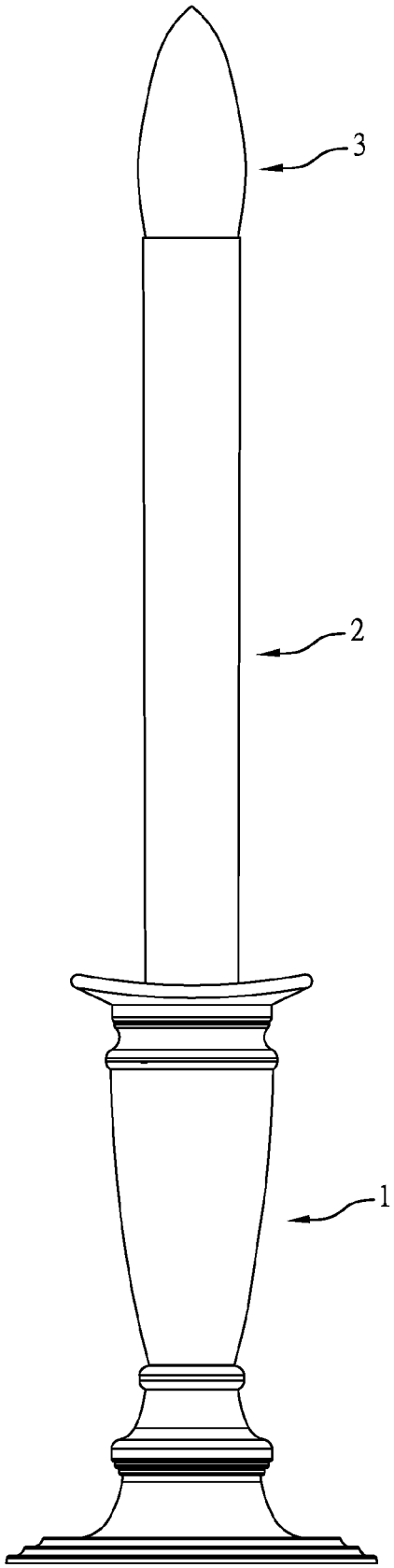
FIG. 2 is an elevational view of the elevation-adjustable window candle in accordance with the present invention.

Referring to FIGS. 1-6, an elevation-adjustable window candle in accordance with the present invention is shown. The elevation-adjustable window candle comprises a holder base 1, a candle shaft 2, an annular locating member 20, and a lampshell 3.

The holder base 1 comprises a stepped vertical insertion hole formed of an upper first insertion hole 11 having a relatively smaller diameter and a lower second insertion hole 12 having a relatively larger diameter and vertically extending to the topmost edge of the holder base 1, a first annular locating groove 111 connected between the upper first insertion hole 11 and the lower second insertion hole 12 for the positioning of the annular locating member 20 to support the candle shaft 2 in the upper first insertion hole 11 (see FIG. 4), and a second annular locating groove 121 located at the bottom side of the lower section insertion hole 12 for the positioning of the bottom end of the candle shaft 2. Further, the diameter of the lower second insertion hole 12 is slightly smaller than the diameter of the upper first insertion hole 11.

Figure 3:
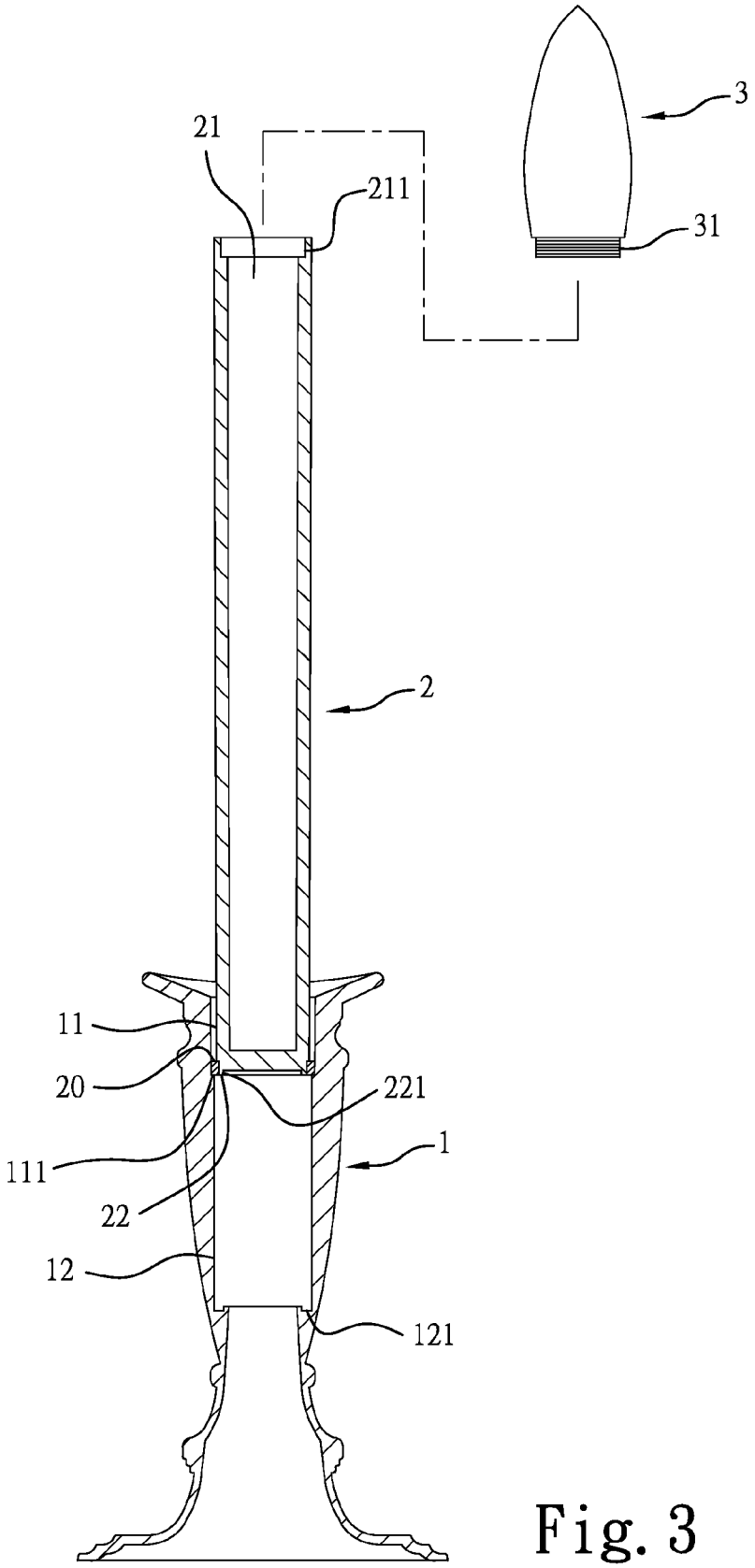
FIG. 3 is a schematic sectional view of the elevation-adjustable window candle in accordance with the present invention.

The candle shaft 2 is a hollow shaft defining an axial hole 21 and an inner thread 211 disposed in the top open end of the axial hole 21 (see FIG. 3). Further, the candle shaft 2 can be inserted through the upper first insertion hole 11 into the lower second insertion hole 12 and positioned in the second annular locating groove 121 (see FIG. 6). Alternatively, the annular locating member 20 can be attached to the bottom end of the candle shaft 2 and set in the first annular locating groove 111 to support the candle shaft 2 in the upper first insertion hole 11 (see FIGS. 1 and 4). Thus, the user can selectively mount the candle shaft 2 in the holder base 1 at one of two different elevations.

The lampshell 3 comprises an outer thread 31 extending around the periphery of the bottom end thereof and threaded into the inner thread 211 of the candle shaft 2. Further, the lampshell 3 holds therein a circuit board carrying at least one light-emitting device, for example, light-emitting diode. Further, a power line (not shown) can be installed to electrically connect the circuit board in the lampshell 3 to a power source, or alternatively, a battery cell (not shown) can be installed and electrically connect the circuit board in the lampshell 3 to provide the necessary working power supply. As the arrangement of this design circuit board and the related power source can be achieved by conventional techniques, no further detailed description in this regard will be necessary.

When assembling the elevation-adjustable window candle, attach the annular locating member 20 to the bottom end of the candle shaft 2 and then insert the candle shaft 2 with the annular locating member 20 into the holder base 1 to let the bottom edge 201 of the annular locating member 20 be positioned in the first annular locating groove 111 inside the upper first insertion hole 11 (see FIG. 4), and thus the candle shaft 2 is supported in the upper first insertion hole 11 by the annular locating member 20 at the first annular locating groove 111 and partially extended out of the holder base 1. Alternatively, the user can remove the annular locating member 20 from the candle shaft 2, and then insert the candle shaft 2, enabling the candle shaft 2 to be positioned in the second annular locating groove 121 (see FIG. 6). At this time, the protruding part of the candle shaft 2 outside the holder base 1 is relatively shorter.

Further, the annular locating member 20 can be an elastic band defining therein a center hole 200. Subject to the elastic material property of the annular locating member (elastic band) 20, the annular locating member 20 can be conveniently fastened to or removed from the bottom end of the candle shaft 2 by hand.

Figure 4:
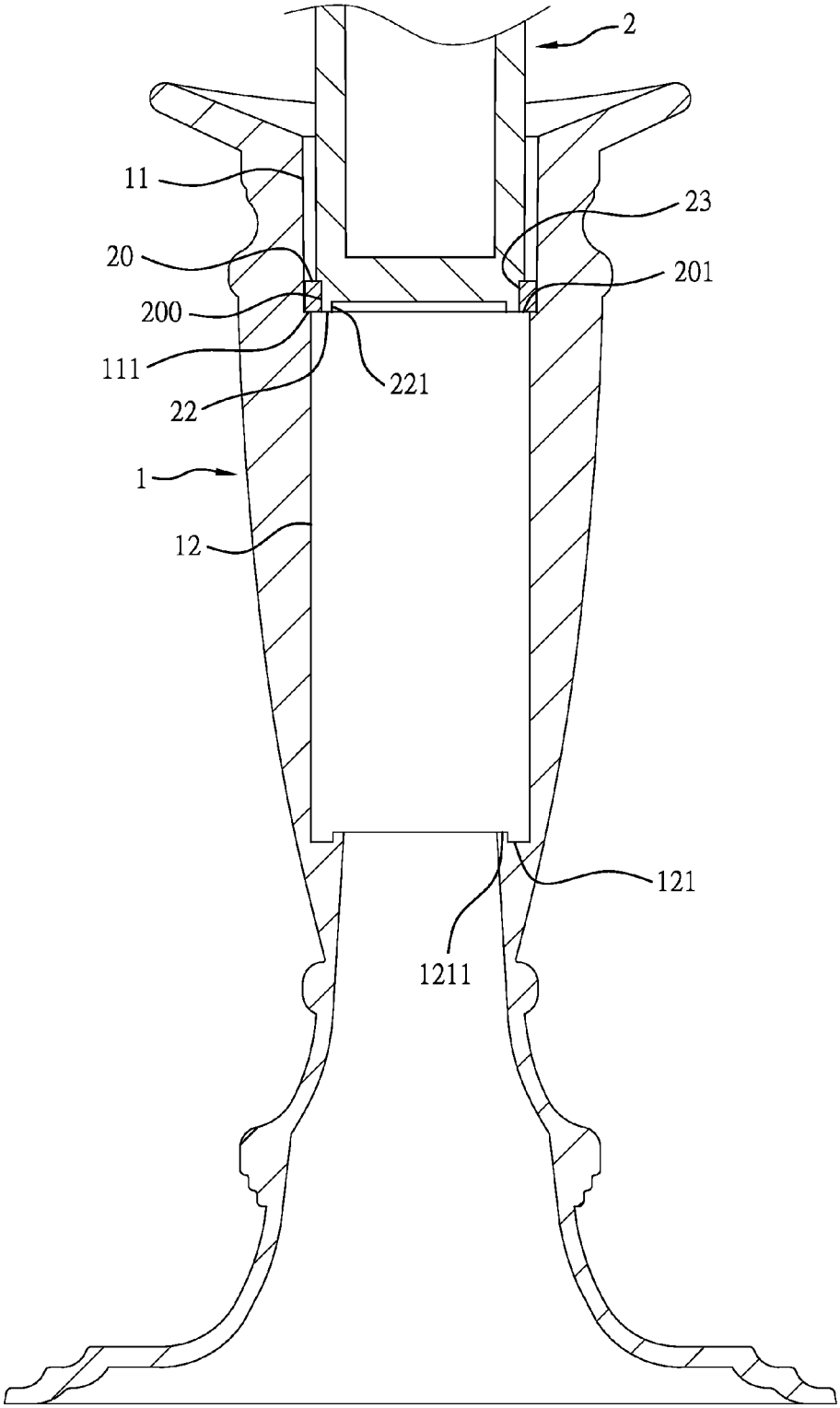
FIG. 4 is a sectional applied view, in an enlarged scale of a part of the present invention, illustrating the candle shaft supported on the annular locating member in the first annular locating groove of the holder base.
Figure 5:
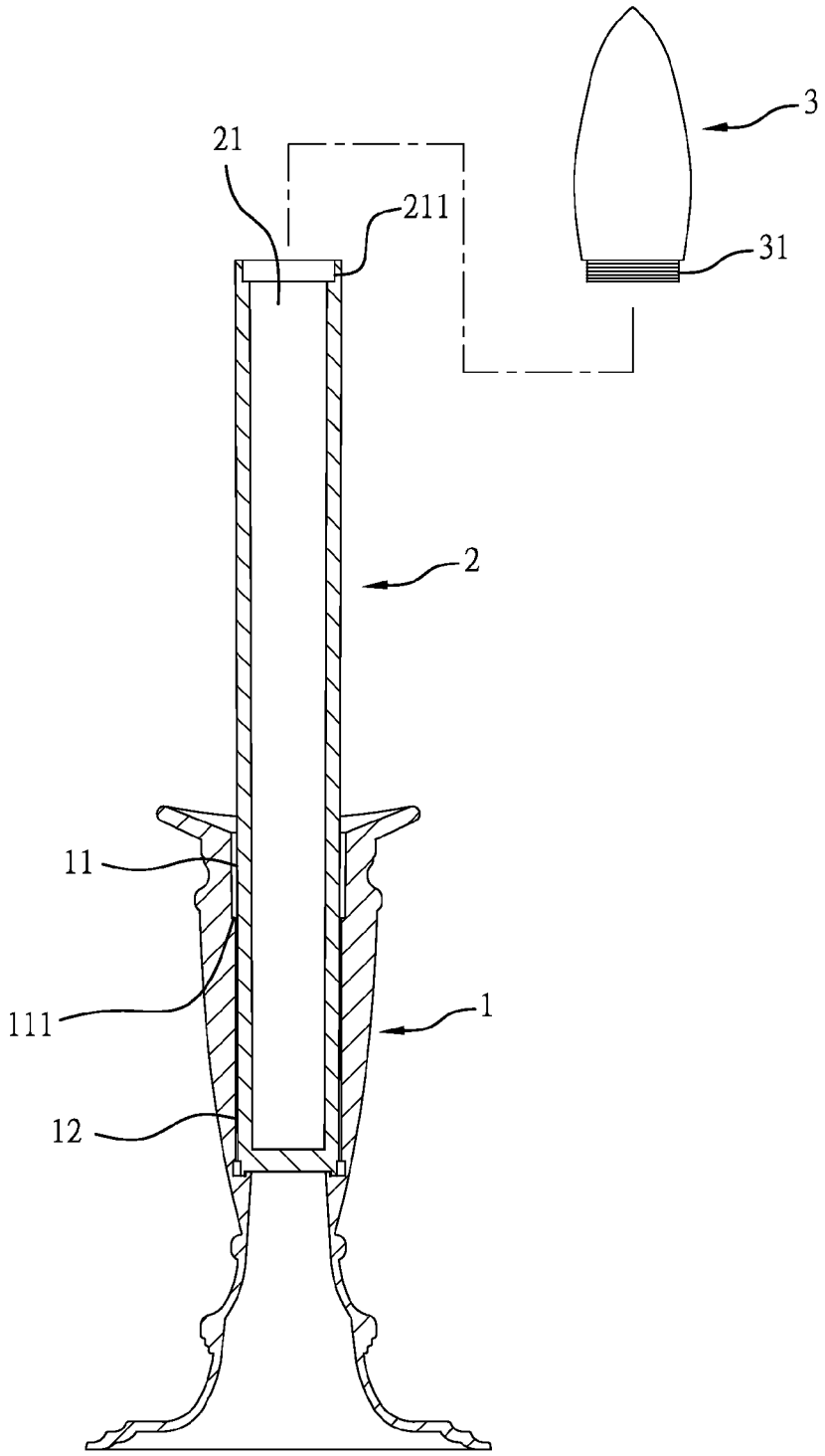
FIG. 5 is a schematic sectional applied view of the present invention, illustrating the candle shaft positioned in the second annular locating groove of the holder base.
Figure 6:
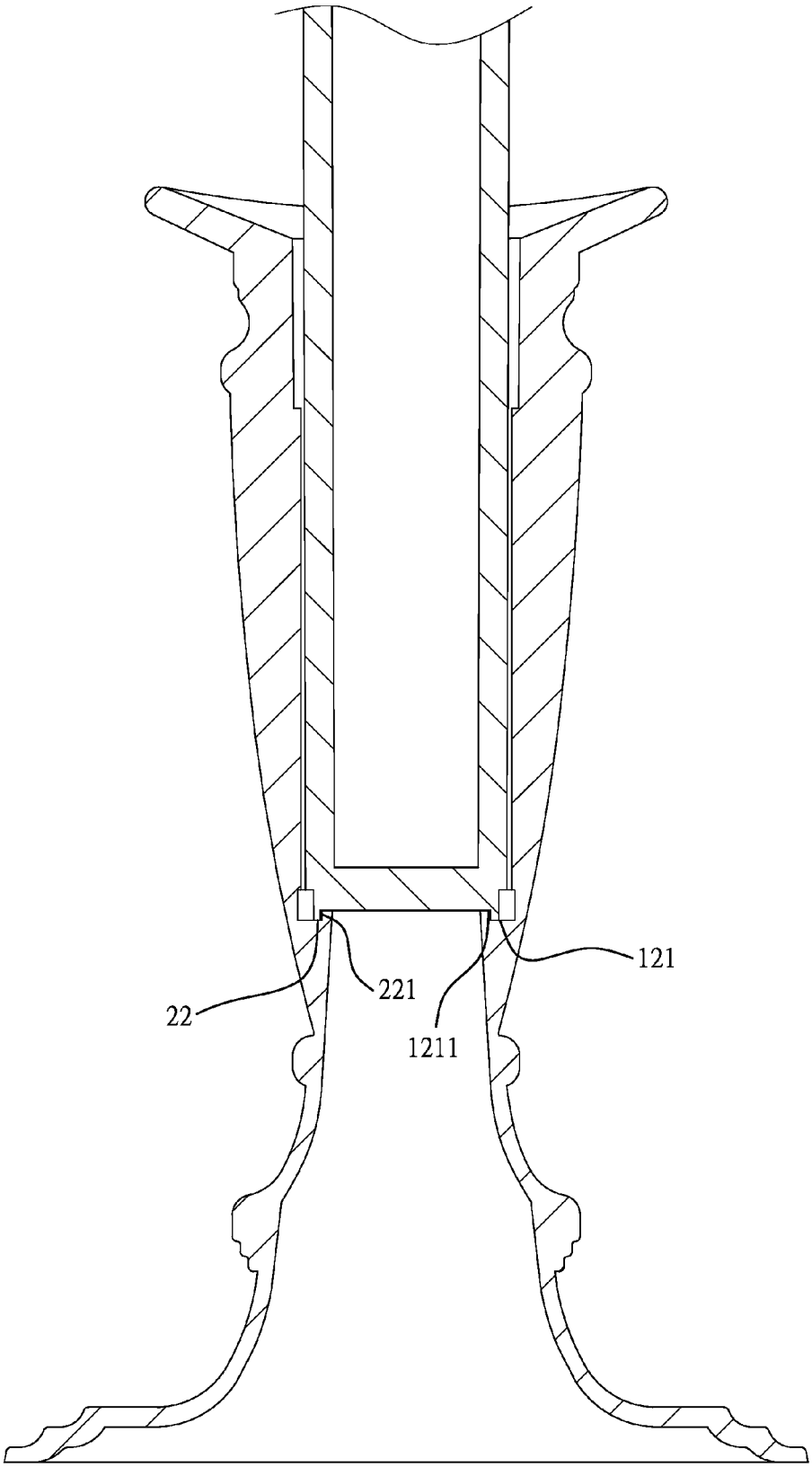
FIG. 6 is an enlarged view of the lower part of FIG. 5.

Further, the holder base 1 further comprises an inside annular flange 1211 surrounded by the second annular locating groove 121 (see FIGS. 4 and 6) for engaging into a circular bottom recess 221 at the bottom wall 22 of the candle shaft 2 to hold the candle shaft 2 in the second annular locating groove 121 (see FIGS. 4 and 6).

Further, the candle shaft 2 comprises an outer annular bottom groove 23 extending around the periphery of the bottom side thereof (see FIG. 4) for the mounting of the annular locating member 20.

Although a particular embodiment of the invention has been described in detail for purposes of illustration, various modifications and enhancements may be made without departing from the spirit and scope of the invention. For example, the holder base can be made having a multi-stepped vertical insertion hole defined therein for the positioning of the candle shaft in one of a series of elevational positions selectively with or without the use of one of a series of annular locating members of different diameters. Accordingly, the invention is not to be limited except as by the appended claims.

In conclusion, the present invention has the following advantages and features:

1. The candle shaft 2 can be conveniently and adjustably positioned in the holder base 1 in one of a series of different elevational positions to fit different application requirements.
2. The elevation-adjustable window candle has a simple structure that can easily be assembled with less labor and time, saving the cost and enhancing product competitiveness.
3. The candle shaft 2 and the holder base 1 are easy and inexpensive to manufacture, lowering the product cost.

What is claimed is:

1. An elevation-adjustable window candle, comprising;

a holder base comprising a stepped vertical insertion hole formed of an upper first insertion hole having a relatively smaller diameter and a lower second insertion hole having a relatively larger diameter and vertically extending to the topmost edge of said holder base, a first annular locating groove connected between said upper first insertion hole and said lower second insertion hole, and a second annular locating groove located at a bottom side of said lower section insertion hole, the diameter of said lower second insertion hole being smaller than the diameter of said upper first insertion hole;

a candle shaft insertable into said stepped vertical insertion hole of said holder base and selectively positionable in one of said first annular locating groove and said second annular locating groove, said candle shaft comprising an axial hole and an inner thread disposed in a top open end of said axial hole;

at least one annular locating member optionally mountable in said first annular locating groove to support said candle shaft in said first annular locating groove; and a lampshell holding therein a circuit board carrying at least one light-emitting device for giving off light, said lampshell comprising an outer thread extending around the periphery of a bottom end thereof and detachably threaded into said inner thread of said candle shaft.

2. The elevation-adjustable window candle as claimed in claim 1, wherein said holder base further comprises an inside annular flange surrounded by said second annular locating groove; said candle shaft comprises a circular bottom recess disposed at a bottom wall thereof and detachably engageable with said inside annular flange of said holder base.

3. The elevation-adjustable window candle as claimed in claim 1, wherein said candle shaft further comprises an outer annular bottom groove extending around the periphery of a bottom side thereof for the mounting of said annular locating member.

* * * * *